United States Patent [19]

Wassmer et al.

[11] 4,147,619

[45] Apr. 3, 1979

[54] ELECTRONIC SORTING APPARATUS

[75] Inventors: Norman B. Wassmer; Franklyn G. Anderson; Joseph L. Hodges, all of Ontario, Oreg.

[73] Assignee: Ore-Ida Foods, Inc., Boise, Id.

[21] Appl. No.: 748,063

[22] Filed: Dec. 9, 1976

[51] Int. Cl.[2] ..... B07C 5/342

[52] U.S. Cl. ..... 209/565; 209/580; 209/587; 209/914; 250/223 R; 356/445; 356/237

[58] Field of Search ..... 209/73, 74 R, 74 M, 209/111.5, 111.6, 111.7 R, 111.7 T; 356/209, 237; 250/223 R, 563, 578

[56] References Cited

U.S. PATENT DOCUMENTS

| | | | |
|---|---|---|---|
| 3,382,975 | 5/1968 | Hoover | 209/111.6 X |
| 3,757,943 | 9/1973 | Chae et al. | 209/111.7 R |
| 3,877,821 | 4/1975 | Price et al. | 356/237 |
| 3,890,221 | 6/1975 | Muehlethaler | 209/111.7 T |

*Primary Examiner*—Joseph J. Rolla

*Attorney, Agent, or Firm*—Mallinckrodt & Mallinckrodt

[57] ABSTRACT

Apparatus for sorting items, such as peeled whole potatoes, which, in the absence of abnormalities, exhibit a substantially uniform light reflectivity, includes an illumination chamber through which the items to be sorted are passed successively as a stream. Light sensors are focused on a cross-sectional slice of the illumination chamber through which the items pass, each of these light sensors being focused on only a small portion of the slice. Electronic circuitry in conjunction with the light sensors counts the number of such sensors sensing abnormalities. If the number of sensors sensing abnormalities is greater than a predetermined minimum, a reject signal is produced. If desired, the circuitry may be arranged to also determine whether the number of sensors sensing abnormalities is greater than a predetermined percentage, for example, 50%, of the total number of sensors sensing the item, and thus produce a second reject signal if the abnromalities make up more than the predetermined percentage. Abnormal items are removed from the stream of items in response to the reject signals. Such removal may be accomplished so that items whose abnormalities exceed the predetermined minimum, but do not exceed the predetermined percentage are sent to one area while items whose abnormalities exceed the predetermined percentage are sent to a different area. One or more air jets may be used to effect the removal.

21 Claims, 15 Drawing Figures

ELECTRONIC SORTING APPARATUS

BACKGROUND OF THE INVENTION

1. Field

The invention is in the field of automatic sorting of items, with removal of those items which do not conform to predetermined standards, and is specifically concerned with the automatic sorting of items of agricultural produce, such as fruits and vegetables, particularly potatoes, to remove abnormal, e.g. defective items.

2. State of the Art

There are numerous machines described in the patent literature for sorting items such as fruit and vegetables. Many of these machines use light sources to illuminate the items to be sorted. In some cases the translucence of an item is a measure of its condition, defective items exhibiting different translucence than sound items. In such cases, light sensors are arranged to detect the light transmitted by the items being sorted. In other cases, the color of an item indicates its condition. In these other cases, reflected light of a certain wavelength is detected by light sensors, and associated filters pass only reflected light of that wavelength to the sensors.

Some items, such as potatoes, exhibit substantially uniform light reflectivity when in normal condition. Defects in the item exhibit different light reflectivities. In such a case, neither translucence nor wavelength of reflected light need be measured, but merely the amount of light reflected. Several sorting machines have been developed on this basis. Machines of this type usually provide several light sensors arranged to monitor respective surfaces of an item to be sorted, each such sensor being adapted to sense light reflected over an entire cross-sectional slice of the illuminated inspection area. Such machines, while satisfactory for small items like rice or beans, lose accuracy and sensitivity when used with larger items like potatoes. Moreover, no provision can be made in these machines for sorting items into different categories based upon relative size or number of defects. For example, because of the size or number of defects, a potato may be unsuitable for a particular use, but it may be economical to remove the defective portion or portions from such a potato or the potato may be suitable for another use provided the defective portion or portions do not exceed a given percentage of the total potato. Under such circumstances, it may be desirable to reject certain potatoes from the main stream and to sort the rejects into separate groups as they are rejected.

SUMMARY OF THE INVENTION

According to the invention, apparatus is provided for effectively sorting items like whole peeled potatoes, which if normal, exhibit uniform light reflectivity. The apparatus includes an illumination chamber for substantially uniformly illuminating the items and for establishing a uniform background of a different light level from that of the light reflected by the items or by abnormalities in the items. Means are provided for successively passing the items through the illumination chamber as a stream.

A number of light sensors, arranged in one or more sets, are adapted to sense the light reflected from items passing through the illumination chamber. Each of the light sensors is capable of distinguishing between light reflected by a normal item, light reflected by abnormalities in the item, and the background in the chamber. The chamber background is preferably brighter than either a normal item or an abnormality in an item. Each sensor is focused to sense only a small portion of a cross-sectional slice of the illuminated area through which the items pass, but each set of sensors comprehends substantially the entire cross-sectional slice of the illuminated area. When more than one set of sensors is used, each set is located so as to focus differently on the cross-sectional slice.

Circuitry is provided to determine the number of sensors in each set sensing abnormalities in an item and addtional circuitry compares the number of sensors sensing abnormalities with a predetermined number. Means are provided to reject an item from the stream of items if the number of sensors sensing abnormalities in an item is greater than the predetermined number, and means are provided to delay the operation of the reject means until the item to be rejected reaches the reject means along its path of travel following the sensing operation.

For items being sorted, such as potatoes, which, although exhibiting abnormalities too numerous to be used in one product line, may be used for a second product line or may economically have the abnormalities removed if such abnormalities make up less than a certain percentage of the total bulk of the item, a circuit is provided to determine the total number of sensors sensing an item. Additional circuitry compares the number of sensors determined to be sensing abnormalities in an item with the total number of sensors determined to be sensing that item.

The reject means is adapted to direct an item out of the stream of items into one of two areas if the number of sensors sensing abnormalities in an item is above the predetermined number, and into the other area of said two areas if the number of sensors sensing abnormalities is greater than a predetermined percentage of the total number of sensors sensing that item.

In the preferred form of the invention, a control circuit is provided for each set of light sensors to generate a clock signal and to sequentially interrogate each sensor of that set in a predetermined pattern and on a timed basis controlled by the clock signal, thereby generating a level, or video, signal proportional to the amount of light sensed by the particular sensor being interrogated. The control circuit also generates an enabling signal indicating whether interrogation of a sensing member is taking place during a particular clock signal.

A data circuit for each set of light sensors determines whether a signal representative of light sensed by a member of that set is above or below a predetermined level, and produces a signal indicative of its determination.

A set of light sensors and control and data circuits therefor are available as a commercial unit in the form of a self-scanning, diode array camera manufactured by Reticon Corporation of Mountainview, California. The camera contains a light sensitive, diode array focused upon a cross-sectional slice of the illumination chamber.

The camera's electronics scan the diode array and four output signals are produced, i.e. a clock signal for timing the scan of the camera's electronics, an enabling signal for indicating clock signals during which video information (a signal proportional to the light sensed by a sensor) is being obtained from a member light sensitive diode, a video signal proportional to the amount of light sensed by a member diode, and a data signal indicating whether the video signal is above or below a predetermined level. The predetermined level for the data signal is usually established such that the data signal will indicate whether or not an abnormality is being sensed by a light sensor.

The video signal from the camera (the signal which is proportional to the light sensed by the light sensors), the clock signal, and the enabling signal are sent to a detecting circuit which determines if the light sensed is above or below a second predetermined level. This second level represents whether or not an item is being sensed. A signal is produced indicating whether a sensor is sensing an item or is sensing the background of the illumination chamber (an item is sensed if a sensor senses either a normal item or an abnormality in an item).

Successive scans of the camera in which at least one of the light sensors senses an item are counted, and, if an item is sensed in a given number of successive scans, e.g. four, an item signal is produced indicating that an item is in view. The item signal will continue to be produced by the circuit until another given number of successive scans, e.g. four, occur during each of which none of the sensors sense an item. The requirement that an item be sensed for a given number of successive scans before an item signal is produced prevents the inadvertant passage of a small stray object from starting operation of circuitry which is provided for controlling operation of reject means. The requirement that no item be sensed during a given number of successive scans before the item signal ceases, prevents a false resetting of the system before an item is actually out of view.

A counting circuit for each camera counts the number of light sensors sensing abnormalities in successive scans of such sensors during the time that an item is in view as indicated by the item signal.

The count information is sent to a comparison circuit for each camera adapted to continuously compare the number of sensors sensing abnormalities with a predetermined number representing the maximum number of abnormalities allowable in the item. When the comparison indicates that the number of sensors sensing abnormalities is above the maximum for any item, a reject signal is produced.

A second counting circuit may be provided for each camera to count the number of sensors determined by the detecting circuit to be sensing an item. If so, a second comparison circuit is provided for each camera to compare, for each item, the number of sensors sensing abnormalities with the total number of sensors sensing the item. If the comparison indicates that the number of sensors sensing abnormalities is greater than a predetermined percentage, for example 50%, of the total number of sensors sensing the item, a second reject signal is produced.

The circuits described so far are associated with a particular set of sensors. Thus, if four cameras are used, four of each of these circuits are involved, one of each being associated with each of the cameras.

Reject signals produced by the comparison circuits of the respective sets of sensors are fed to a single interface means, which, upon receipt of a reject signal, initiates operation of the reject means to cause the abnormal item to be removed from the stream of items. The reject means will usually be one or two jets of air(depending upon whether or not the second counting and comparison circuits are employed) for deflecting abnormal items from the main stream of items.

If second counting and comparison circuits are provided, so that a second reject signal may be generated for an item, jet nozzles making up the reject means are arranged so that abnormal items are pushed out of the stream of items into either one of two different areas, and the interface means is adapted to cause operation of the reject means for this purpose. Thus, for example, an item is directed into one of the two possible areas upon a reject signal from the first comparison means (the first reject signal) and into the other of the two possible areas upon a reject signal from the second comparison means (the second reject signal).

Since the reject means will usually be located downstream from the illumination chamber, there will be a lag time between the observation of an item and the passage of such item past the reject means. Accordingly, delayed operation of the reject means is provided for. Such delay may be provided by the interface or reject means. Preferably, however, the correct delay time between generation of a reject signal and the operation of the reject means is provided by an item tracking circuit and a memory means. The memory means is provided to store the reject signals or an indication that no reject signal has been generated for a particular item observed. The reject signal or indication of absence of reject signal is stored for each of a successive number of most recent items observed. Generally, storing information for the four most recent items observed will be sufficient.

The item tracking circuit keeps track of items as they flow through the illumination chamber and past the reject means, and causes information in the memory means applicable to the respective items to be transmitted to the interface means at the proper times. The tracking circuit may merely be a time delay circuit set for the proper delay time between an item's being observed in the illumination chamber and its passage past the reject means and may include a shift register to produce the proper delay time. Timing is begun at the start of an item signal, which represents an end of the item coming into view in the illumination chamber.

The illumination chamber preferably comprises a circular housing having a central passage through which the items to be sorted are passed successively, as a stream, by gravity. A plurality of light sources are mounted in spaced circumferential relationship in the housing, so that a substantial portion of the light from the sources is directed toward the items passing through the chamber and so that a circumferential series of substantially uniformly illuminated areas are produced between light sources. The sets of light sensors, i.e. cameras, are mounted so that they will receive and sense light reflected by objects as they pass through the chamber, and so that, when no object is in view in the chamber, they will sense the uniformly illuminated areas as background.

The illumination chamber preferably provides for the circulation of air as a cooling means for the lights. The air circulation is such that there is a flow of air out through the central passage in the chamber, to prevent dust and dirt from entering the chamber.

Additional light sources are preferably located above and below the chamber to ensure proper lighting of the upper and lower ends of the items to be sorted.

THE DRAWINGS

The best mode presently contemplated for carrying out the invention is shown in the accompanying drawings, in which:

FIG. 1 is a top plan view of the illumination chamber of the apparatus, including portions of a feeding device and a discharge device;

FIG. 2, an elevation looking from the front in FIG. 1;

FIG. 3, an end elevation looking from the right in FIG. 2 minus the feeding device, the hopper being shown in vertical section;

FIG. 4, a top plan of the illumination chamber as taken on the line 4—4 of FIG. 2 and drawn to a larger scale, portions of the top cover plate being broken out and the light cover plate being removed to show the interior of the chamber;

FIG. 5, a view in vertical section of the illumination chamber as taken on the line 5—5 of FIG.. 4;

FIG. 6, a vertical section similar to that of FIG. 5, but taken on the line 5—5 of FIG. 4;

FIG. 7, a block diagram of the electronic portion of the system;

FIG. 8, a circuit diagram of the detecting circuit of FIG. 7;

FIG. 9, a circuit diagram of the first counting circuit;

FIG. 10, a circuit diagram of the second counting circuit

FIG. 11, a circuit diagram of the first comparison circuit;

FIG. 12, a circuit diagram of the second comparison circuit;

FIG. 13, a circuit diagram of the item tracking circuit;

FIG. 14, a circuit diagram of the memory means; and

FIG. 15, a circuit diagram of the interface means and reject means.

DETAILED DESCRIPTION OF THE ILLUSTRATED EMBODIMENT

Figure 1:
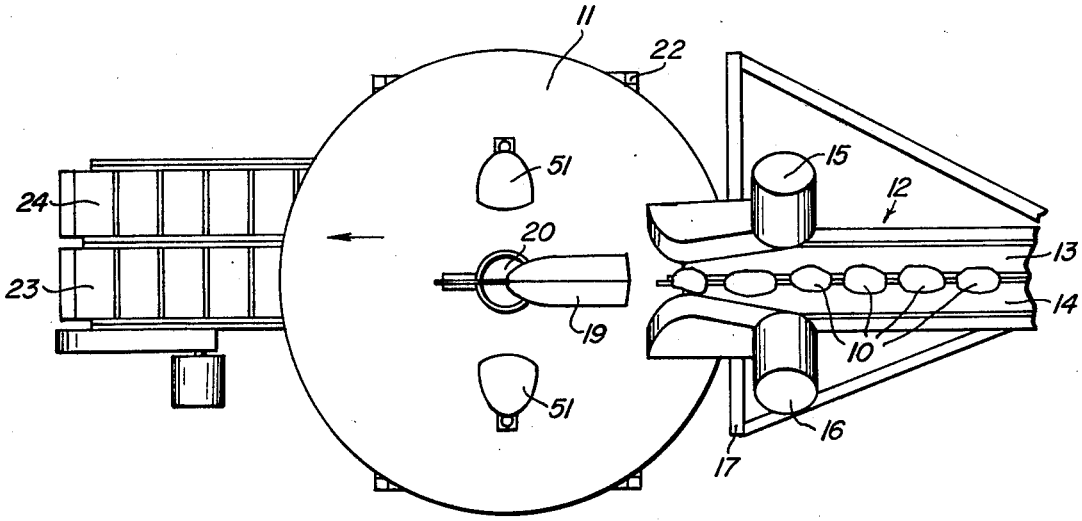
Figure 2:
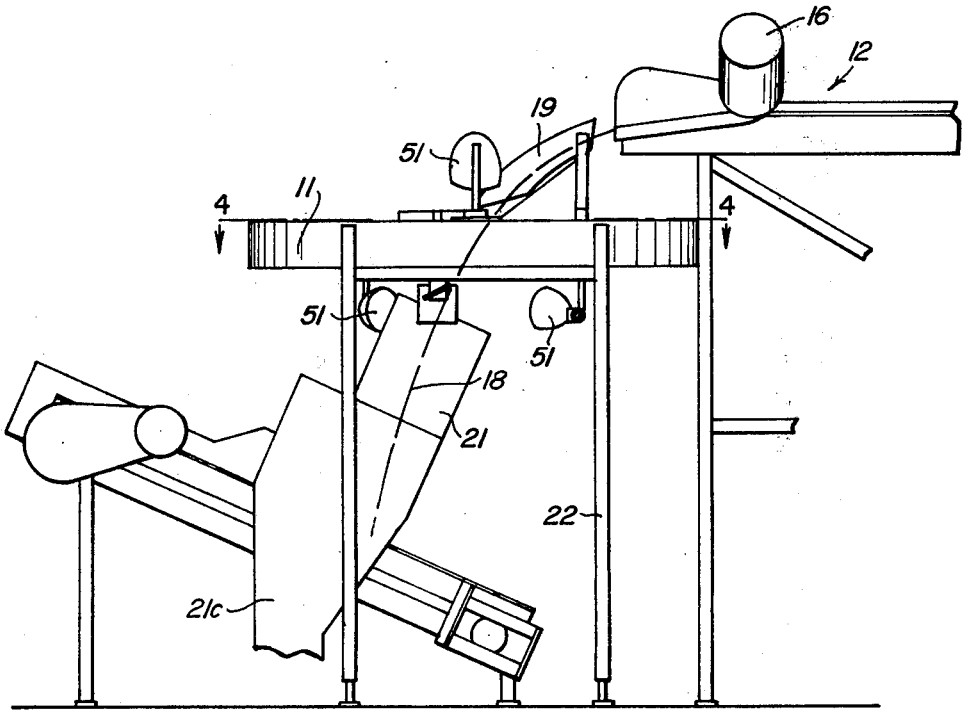
Figure 5:
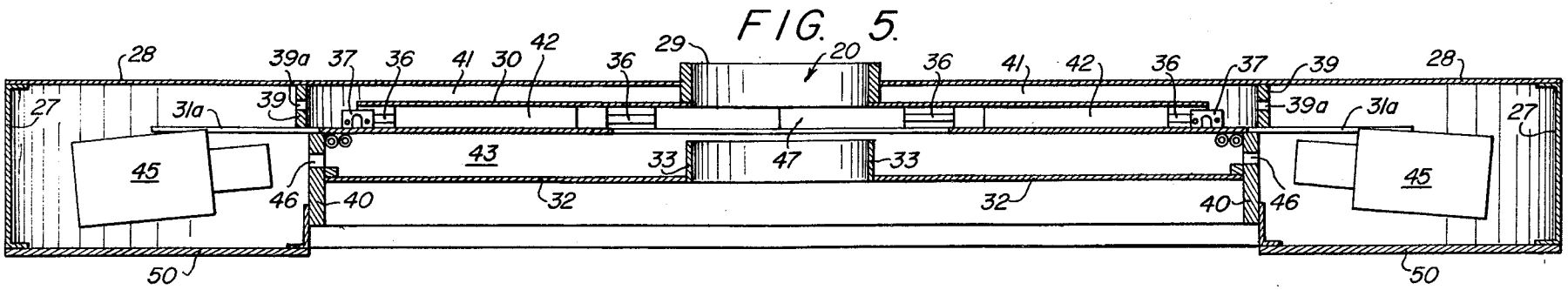

In the form illustrated, the apparatus of the invention is adapted to sort peeled, raw, white potatoes 10, which are successively fed into an illumination chamber 11 at a rapid rate by any suitable means, such as a belt conveyor 12. As shown, such conveyor comprises individual belts 13 and 14 arranged in V configuration and driven by respective motors 15 and 16. Supporting structure 17 positions conveyor 12 so its discharge end is above illumination chamber 11 and is placed to project the discharged potatoes along a trajectory 18, FIG. 2, that passes into and through, first, a guidance conduit 19 and, then, a vertical passageway 20 extending from top to bottom of chamber 11, see particularly FIGS. 5 and 6. The trajectory 18 is modified by the guidance conduit so that the potatoes fall along a somewhat arcuate path through passageway 20.

Illumination chamber 11 is supported horizontally below guidance conduit 19 and above a receiving hopper 21 by means of suitable structure, such as that shown at 22. Hopper 21 comprises side-by-side sections **21*a*, 21*b*, and 21*c***.

Figure 3:
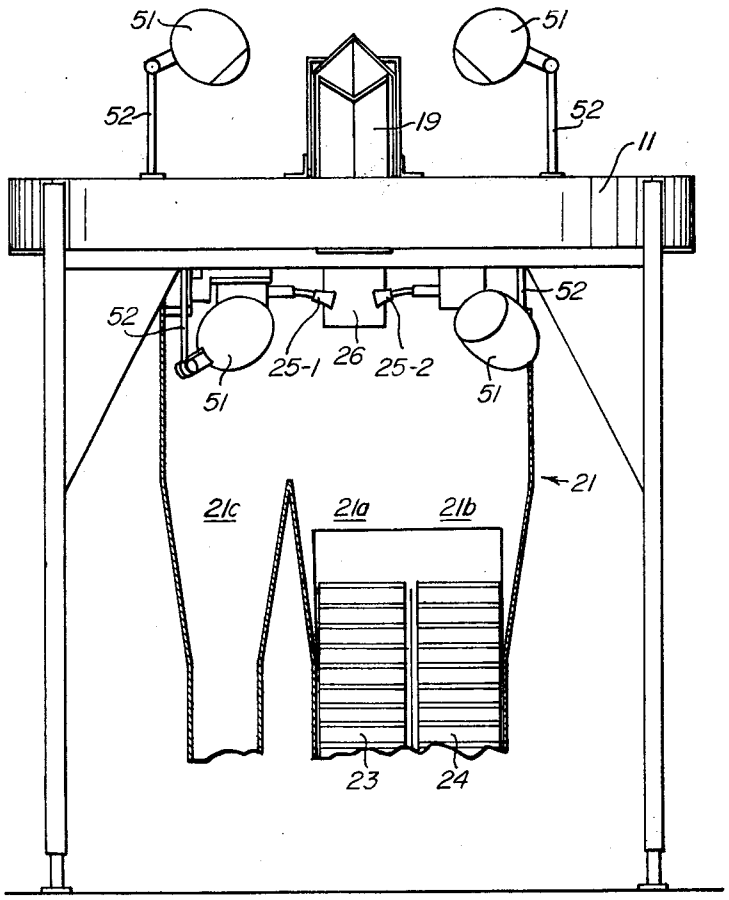

Sections **21*a* and 21*b* of hopper 21 are opposite portions, respectively, of a single chute positioned above a pair of cleated conveyor belts 23 and 24, FIG. 3. Discharge of potatoes onto one or the other of the belts, or to waste through hopper section 21*c*, depends upon the path of travel of the individual potatoes through the hopper. Reject means in the form of jet nozzles 25-1 and 25-2 are connected with a source of compressed air and are directed oppositely across the path 18 of potatoes falling into hopper 21. Defective potatoes are rejected from the main stream of potatoes entering the hopper by moving them from such main stream into one or the other of hopper sections 21*b* and 21*c*. Such movement is effected by a blast of air from one or the other of nozzles 25-1 and 25-2 directed toward and pushing against a potato which would otherwise fall onto belt 23. An indexing plate 26 adjacent to nozzles 25-1 and 25-2** insures proper passage of each potato past the nozzles for action thereon by an air blast issuing from one or the other of the nozzles in appropriate instances.

Suitable air valves (not shown), consituting part of the reject means, are controlled by the response of sensors in illumination chamber 11 to light reflected from the potatoes as they pass therethrough. An air blast issues from either nozzle 25-1 or nozzle 25-2 only when the reflected light indicates to the sensors that a particular potato is defective, the extent of the defect or defects determining which nozzle will become active. An air blast issues from only one of the nozzles for each defective potato.

Illumination chamber 11 is preferably circular, having a peripheral wall 27 and a top wall, i.e. cover plate, 28 that is removably attached to the peripheral wall in any suitable manner. Passageway 20 is disposed centrally of chamber 11, being defined with respect to top wall 27 by means of a collar 29, see particularly FIGS. 5 and 6, extending upwardly from a horizontal partition wall 30, which serves as a light cover plate, and through a receiving hole in top wall 28. Light cover plate 30 is part of internal structure in illumination chamber 11 that includes an intermediate, supporting plate 31 and a lower plate 32 having a collar 33 in registry with but spaced below collar 29 and serving to further define passageway 20. Fitting snugly between light cover plate 30 and light-supporting plate 31 are divider walls 34, FIG. 4, of V formation and having mutually similar light-reflecting surfaces confronting respective light-transmitting passages 35 which they define. Such passages extend from electric lamps 36 to passsageway 20 through which the items to be sorted pass.

It is desirable that the apex edges **34*a* of the respective V walls be as sharp as possible, so the light from the several passages 35 will merge immediately upon reaching central passageway 20. It should be noted that the background for the light sensors of the cameras are the wall surfaces that define passages 35**. If the apex edges are sharp, the cameras only see the illuminated wall surfaces as a background. If the apex edges are blunt, dark lines appear in the background.

Lamps 36 are preferably of quartz-iodine type, since lamps of this type produce a fairly constant light output throughout their life spans. They are elongate and fit into electrical power sockets 37 at their opposite ends. Light reflective walls 38 are provided in back of lamps 36.

Figure 4:
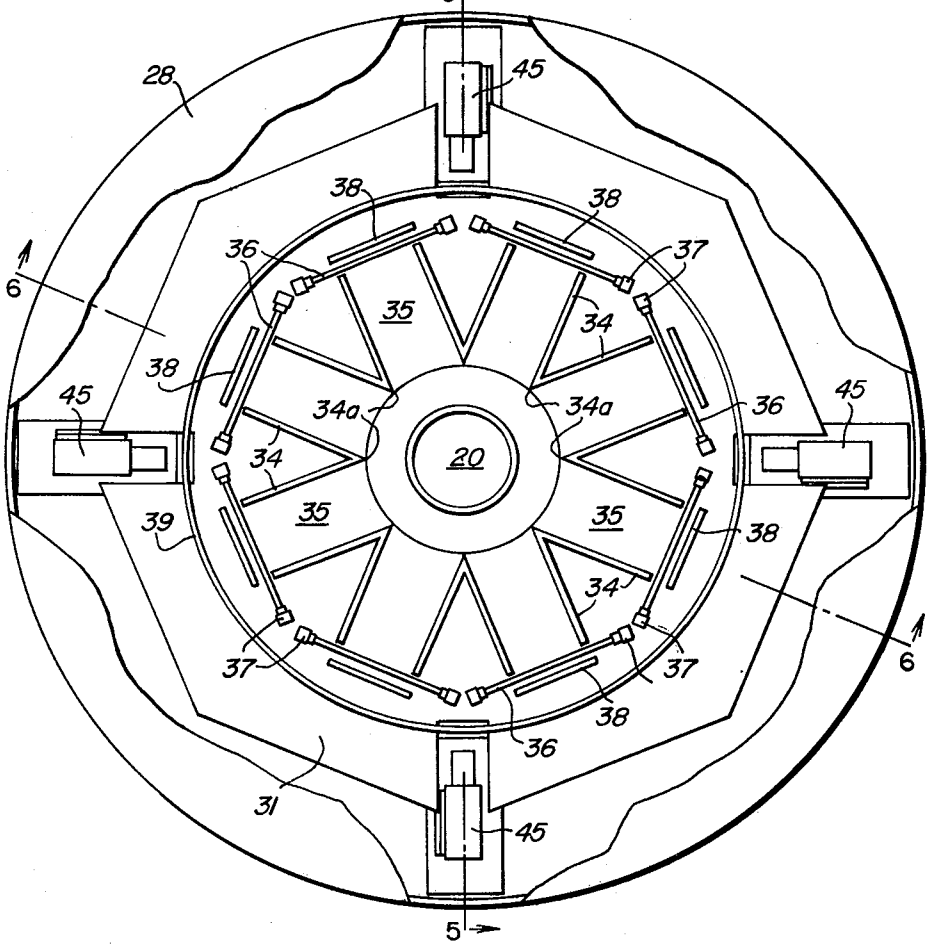

Vertical walls 39 and 40 of annular formation and more or less peripheral to plates 30, 31, and 32, provide airflow chambers 41, 42, and 43, and, along with an annular bottom wall 44, close illumination chamber 11 peripherally to provide protective housing for self-scanning, diode array cameras 45, FIG. 4.

Cameras 45 are conveniently attached to and supported by overhanging marginal formations **31*a* provided by light supporting plate 31. They are directed through respective viewing openings 46** in vertical wall 40 so as to focus on a cross-sectional slice 47 of passageway 20 through illumination chamber 11.

Figure 6:
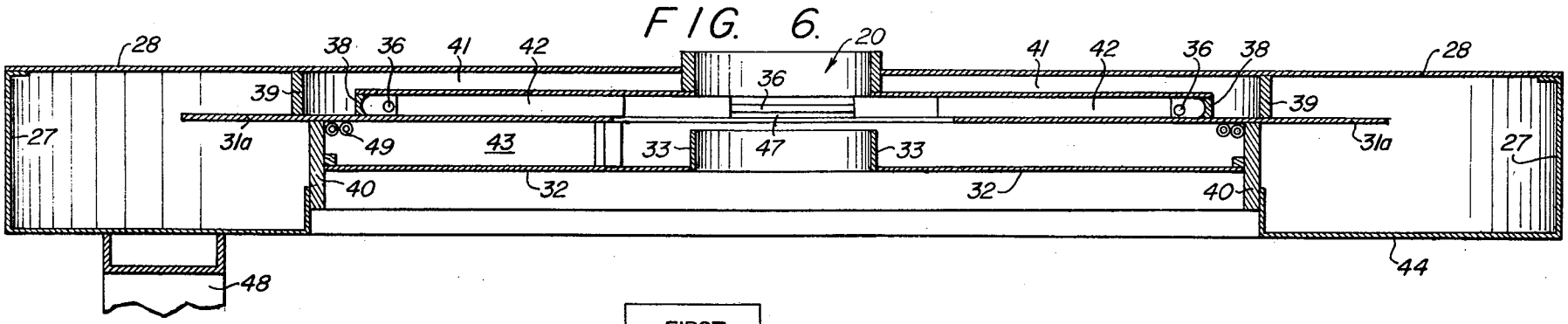

For cooling illumination chamber 11 and preventing dust and dirt from entering through passageway 20, a blower (not shown) is provided to introduce air into the protective housing for the cameras by way of a duct 48, FIG. 6. Pressurized air passes through openings 39*a* in vertical wall 39, entering chambers 41 and 42 and exiting through passageway 20. Similarly, pressurized air passes through viewing openings 46, entering chamber 43 and exiting through passageway 20. For cooling purposes, piping 49 may be provided in chamber 43 to circulate a coolant, such as cold water.

In order to provide easy access to the cameras 45, an access opening is provided in bottom wall 44 below each camera, and a plate 50 is removably secured over the opening by any suitable means, such as screws.

Structural materials employed in the construction of illumination chamber 11 are preferably stainless steel, aluminium, and similar materials usual in food processing equipment, since the potatoes are intended for human consumption.

The high intensity light produced by lamps 36 is directed into central passageway 20 and illuminates all surfaces of the potatoes passing therethrough. Cameras 45 are directed and focused so that the light-sensing diodes thereof sense the light reflected from the potato surfaces. If no potato is in view, the diodes sense the very bright background provided by the passage-defining surfaces of walls 34. Such background light is brighter than the light reflected by a potato of normal condition. A typical camera is provided with a 50 mm lens and with a 5 mm lens extender.

During operation, there are normally three distinct light levels that must be detected by the light-sensitive diodes in the camera. High intensity light is needed in the illumination chamber, because of the speed of the potatoes as they pass through the light band constituting slice 47 and because of the scanning speed of the camera. The set of sensors provided by each camera typically comprises 256 light sensitive diodes and the complete array is scanned (i.e., each member of the set is individually interrogated to determine the light level sensed by it) 2000 times a second. The potatoes are typically traveling at a speed of 680 feet per minute as they pass through the illumination chamber. This means that the camera is able to make about ten scans for each inch of potato length. It is known that the faster the speed of the object being illuminated and the faster the scan rate of the camera, the higher the intensity of illumination of the object that is required in order to be able to sense reflected light. Eight 1500 watt lamps have been found to provide satisfactory illumination for the potato speed and scan rate mentioned.

If the potatoes are only illuminated as so far indicated, their curved ends appear darker to the camera than the rest of their bodies as they enter and leave the field of view. Therefore, in order to sufficiently increase the illumination at the ends of the potatoes, additional lamps 51, FIG. 3, are provided above and below passageway 20. These lamps are typically 500 watt quartz lamps of standard type, the two above being mounted on supports 52 attached to top wall 29 of illumination chamber 11 and the two below being similarly mounted on lower plate 32 of such chamber.

The electronics for the system are usually mounted at a distance from the illumination chamber and are electrically connected with the cameras and with the control valves of the reject means by appropriate wiring.

Figure 7:
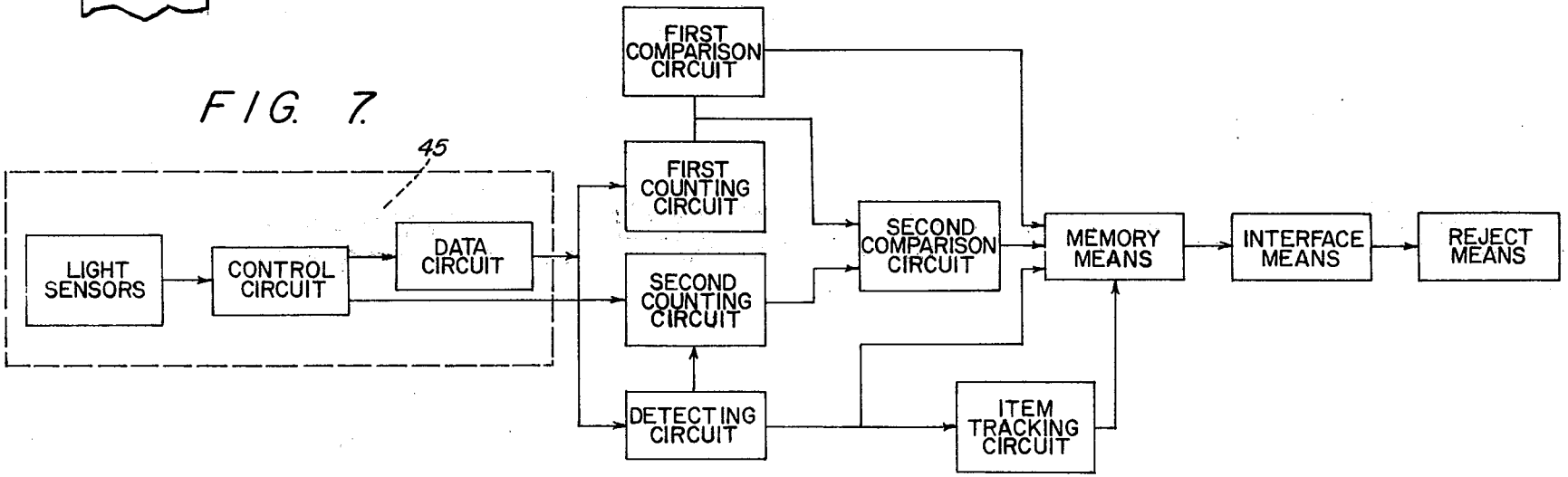

Presently preferred electronics are shown in block diagram in FIG. 7. In describing the circuitry and operation thereof, the terms "high level", "high signal", and "high output" mean a voltage of + 5 volts D.C., and the terms "low level", "low signal", and "low output" means a 0 voltage. A "negative-going pulse" or a "negative pulse" is a change from a high, + 5, level to a low, 0, level.

As mentioned earlier, each set of light sensors, the control circuit associated therewith, and the data circuit associated therewith are all part of an individual, self-scanning, diode array camera 45, as obtained commercially from Reticon Corporation. The particular camera used in this circuitry is a Model LC 600 C256-2. The dotted box in FIG. 7 represents such a camera.

The camera produces four output signals, namely, a clock signal, which is used to control the rate of interrogation of the individual light sensors, i.e. diodes of the diode array; a video signal, which is an analog level signal proportional to the amount of light sensed by the sensor being interrogated; an enabling signal which goes high during the clock pulses, when sensors are being interrogated and thus are producing video signals (the camera interrogates each of the 256 diodes on successive clock pulses during a scan), and low otherwise (there is a period of several clock pulses between successive scans); and a data signal that goes high when the video signal from an interrogated sensor is above a predetermined level and goes low when the video signal is below the predetermined level.

Illumination chamber 11 is designed so that the background is the brightest light sensed by the sensors and, thus, produces the highest video signal. The light reflected from a potato in normal condition is less bright and produces a moderate video signal. The light reflected from an abnormality, i.e. a defect, in a potato produces very little reflected light, thus producing a very low video signal. The predetermined level for the data signal is between the level of the video signal, indicating a defect, and the level of the video signal, indicating normal condition. Therefore, the data signal is high for any sensor sensing a normal potato or the background, and is low for any sensor sensing a defect in a potato.

Figure 8:
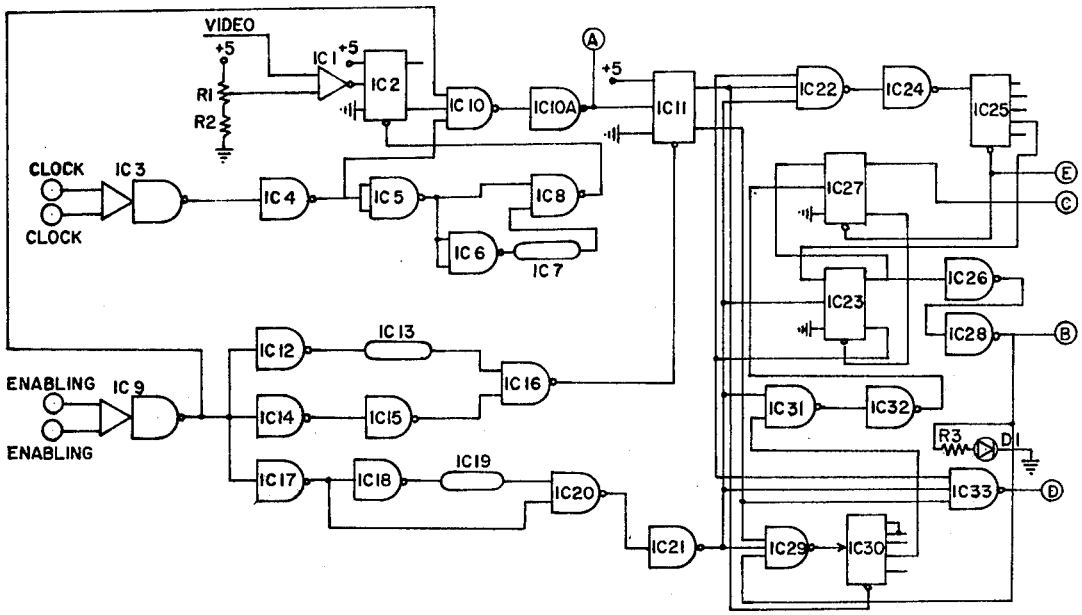

FIG. 8 is a circuit diagram showing the detecting circuit of FIG. 7 in detail. A video signal from the camera enters this circuit as indicated, passing directly into IC1, a high speed differential comparator, such as a Fairchild UA760, which compares the voltage of such video signal with the reference voltage on the second input indicated for IC1. The reference voltage is the voltage at the wiper of resistor R1. Resistors R1 and R2 form a voltage divider. R1 is variable so that the voltage applied to IC1 may be adjusted. The voltage on the wiper of R1 is adjusted to be at a level above the level of the video signal representative of a sensor sensing normal potato flesh, but below the level representative of a sensor sensing the background. The output from IC1 goes high when the video signal is above the reference voltage (background being sensed) and goes low when the level of the video signal is below the reference voltage (indicating potato or a defect being sensed). Thus, IC1 produces no output when a potato is in view.

The output signal from IC1 enters IC2, a flip-flop such as a Signetics N7473 J-K flip-flop, which goes low for each clock pulse from the camera when a potato is sensed by a sensor. A potato is considered sensed if the sensor senses either normal potato flesh or a defect.

The clock signal from the camera enters the circuitry through IC3, a differential line receiver such as a Fairchild 9620. The camera produces two clock signals, one the opposite of the other, i.e. when one signal is high the other is low and vice versa. Both signals are fed to IC3, which senses change between the two signals and produces output pulses coincident with the clock pulses. IC3 eliminates any noise that may be present in the clock signal and acts as a buffer to prevent the circuitry from loading the camera clock pulse circuitry. The clock signal from IC3 is inverted by an inverter IC4, such as a Signetics N7404. IC5, a NAND gate, operates to invert the clock signal again, as does IC6. Component IC7 is a delay line, such as an Engineered Components Company 591, used to delay the clock signal by 90 nanoseconds. The clock signal from IC5 and the inverted and delayed clock signal from IC7 are inputs to NAND gate IC8, which produces a 95 nanosecond pulse beginning with the leading edge of the clock pulse. The pulse from IC8 is sent to flip-flop IC2 and causes the flip-flop to reset with each clock pulse.

The NAND gates used throughout the circuitry may be Signetics N7400, two input, or Signetics N7410, three input, NAND gates. Integrated circuits of the same general type throughout the circuitry may be specifically the same as those particularly identified when the general type is first mentioned.

An enabling signal from the camera (opposite enabling signal outputs are provided by the camera) enters the circuitry through IC8, a differential line receiver similar to IC3, which produces coincident enabling pulses but acts as a buffer to prevent loading of the camera circuitry and to eliminate any noise in the enabling signal.

The signal from flip-flop IC2, the inverted clock signal from IC4, and the enabling signal from IC9 are all inputs to NAND gate IC10. The output of IC10 is a negative going pulse when a potato is sensed by a sensor being interrogated. The output of IC10 is inverted by inverter IC10*a*, which goes high and produces a positive pulse for each clock period during which a potato is sensed. The output of IC10*a* is sent to the circuits of FIGS. 9 and 10 through conductors interconnected at terminal A. (Here it should be noted that various terminals referred to in discussing the circuitry are merely for convenience in indicating interconnections between the several circuits shown by different figures of the drawings and do not usually represent actual terminals. They merely serve to indicate where signals produced by the circuitry illustrated in one figure are sent to circuitry illustrated in another figure.) The output signal from IC10*a* is the input signal to flip-flop IC11.

The enabling signal from IC9 is inverted by inverter IC12 and is delayed by 150 nanoseconds by delay line IC13. The enabling signal from IC9 is also inverted by inverter IC14 and inverted again by IC15. The enabling signal from IC15 and the delayed inverted enabling signal from IC13 are inputs to NAND gate IC16, which produces a 150 nanosecond pulse at the beginning of each enabling pulse. The output of IC16 is used to reset the flip-flop IC11 at the beginning of each enabling pulse.

IC11 produces one output that goes high for each scan (each enabling pulse) during which one of the sensors senses a potato. The other output goes low for each scan during which one of the sensors senses a potato.

The enabling pulse from IC9 is also inverted by IC17. The inverted output is an input to both IC18, which reinverts the signal and sends it to 150 nanosecond delay line IC19, and to NAND gate IC20. The delayed signal from IC19 is the other input of IC20. IC20 produces a 150 nanosecond negative going pulse beginning at the end of an enabling signal. The pulse from IC20 is inverted by IC21.

When operation of the circuit first begins and before a potato comes into view, the output of IC11, which goes high when a potato comes into view, is low. This output is an input of NAND gate IC22. The output of IC21, which is a 150 nanosecond positive pulse at the end of each enabling pulse (the end of each scan of the sensors by the camera), is also an input to IC22. The third input to IC22 comes from a flip-flop IC23. This flip-flop should be in its reset state when operation of the circuit begins. In that state, the output, which is an input to IC22, will be high. The output of IC22 is thus high.

When a potato is sensed by a sensor during a scan, the output of IC11, which is an input to IC22, becomes high. At the end of the scan, upon receiving the positive pulse from IC21, all inputs of IC22 being high, the output of IC22 goes low. The output is low for the 150 nanoseconds during which all inputs are high. This pulse output of IC22 is inverted by inverter IC24 and becomes a positive pulse, which is sent to binary counter IC25. This counter may be a Signetics N7493. It is connected so that it counts four pulses from IC24, and, upon receipt of the fourth pulse, the output shown goes high. (Actually, there must be four consecutive pulses counted, because the counter is reset as explained later if a scan occurs with no potato sensed).

The high output of IC25 causes the outputs of flip-flop IC23 to change state at the end of the next pulse from IC21 (the end of the next scan). This causes the output of IC23, which is an input of IC22, to go low, causing the output of IC22 to remain in its high state (no more pulses produced) until flip-flop IC23 is reset, and causing the output of IC23, which is the input to inverter IC26, to go high. The high output from IC23 is also one input of flip-flop IC27.

The high output of IC23, inverted by IC26, is inverted again by inverter IC28. This provides a positive signal after four successive scans of the camera, during each of which at least one sensor has sensed a potato. This signal is also an input of NAND gate IC29. The other inputs of IC29 are the output of IC21 and the output of IC11 that is high when a potato is not sensed during a scan and is low when a potato is sensed during a scan. For any scans occurring before the output of IC28 goes high, the output of IC29 will be and will remain high, since all inputs of IC29 cannot be high. Once the output of IC28 goes high, the output of IC29 will go low at the end of a scan during which no sensors have sensed a potato. The negative going pulses from IC29 are counted by binary counter IC30, which is connected to produce a high output after four successive pulses from IC29 (four scans with no potato sensed). IC30 is reset when the output of IC11 goes high, indicating a scan during which a potato is sensed. Four successive scans without a potato in view are therefore required to produce an output from IC30.

The high output from counter IC30 is an input to NAND gate IC31. The output of IC21 is also an input to IC31. With the output of IC30 high, IC31 produces a pulse upon receipt of the pulse from IC21 at the end of the enabling signal. The puse from IC31 is inverted to a positive pulse by inverter IC32 and is sent to flip-flop IC27.

With the output from IC23 (that is an input to IC27) high, upon receipt by IC27 of the end of the positive pulse from IC32, the output of IC27 changes state so that the output of IC27 (used to reset flip-flop IC23) will go low, causing IC23 to reset and causing the output of IC27 (that is sent to the circuitry of FIGS. 12 and 14 through conductors interconnected at terminal C) to go high. When IC23 is reset, the outputs change state and the output that is sent to IC22 again goes high and the output that is sent to IC26 and to IC27 again goes low.

The output from IC11 that goes high for a scan during which no sensor senses a potato, the output of IC21, and the output of IC23 that is high before four scans are counted (during each of which at least one sensor sensed a potato) are all inputs to NAND gate IC33. When all inputs to IC33 go high (this occurs at the end of a scan during which no potato has been sensed by a sensor, provided that such scan occurs before four successive scans, during which potatoes have been sensed, have been counted by IC25), the output of IC33 goes low. This negative going pulse is sent to the circuitry of FIG. 11 by means of conductors interconnected at terminal D.

Figure 11:
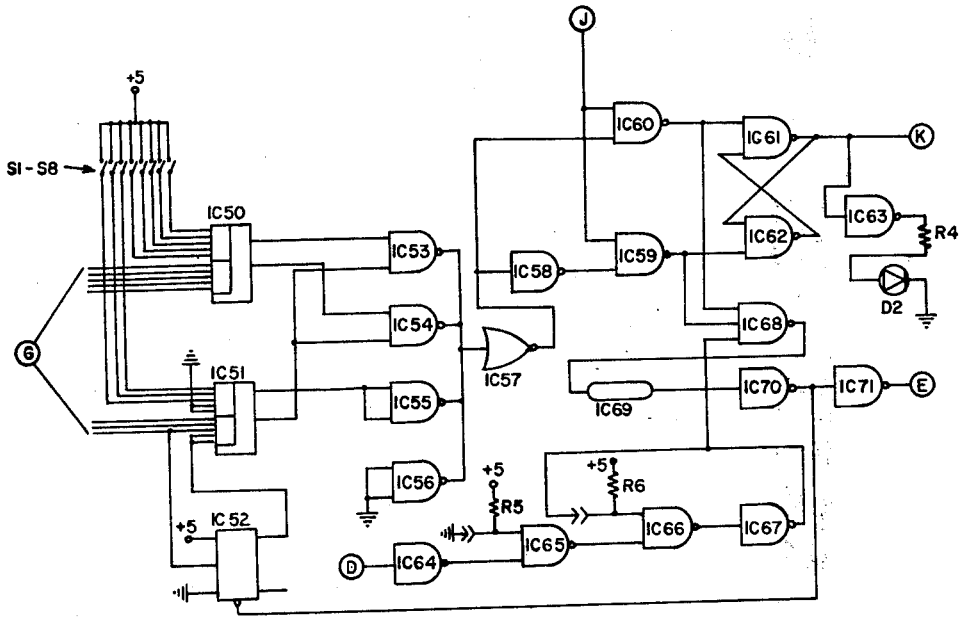

The circuitry of FIG. 11 supplies a reset signal to the circuitry of FIG. 8 if a potato is not sensed during four successive scans, or if, after a potato has been sensed during four successive scans, no potato is sensed during four additional successive scans. The reset signal is used to reset counter IC25 and flip-flop IC27. The signal is sent to FIG. 8 through conductors interconnected at terminal E. A light-emitting diode D1 provides a visual indicator when the output of IC28 goes high, indicating four scans during each of which a sensor has sensed a potato. Resistor R3 limits the current flow through D1.

To review the general operation of the circuitry of FIG. 8, the circuitry receives the video, clock, and enabling signals from the camera and a reset signal from the circuitry of FIG. 11. The circuit produces the following output signals; at terminal A, a positive pulse for each sensor sensing a potato; at terminal B, a positive signal after four successive scans occur during each of which at least one sensor has sensed a potato (for convenience called "start potato signal"), the signal remaining positive until four successive scans occur during each of which no sensor senses a potato; at terminal C, a positive signal after four successive scans occur during each of which no sensor senses a potato (for convenience called "end potato signal"), such signal remaining positive until a reset signal from FIG. 11 is generated; and at terminal D, a negative going pulse for each scan during which no sensors senses a potato if such scan occurs before four successive scans are counted during each of which at least one sensor senses a potato.

It has been found that occasionally a scan will occur during which it erroroneously appears that none of the sensors have sensed a potato. The requirement that four successive scans with no potato sensed occur before generating an end of potato signal prevents these erroroneous scans from resetting the circuitry.

Figure 9:
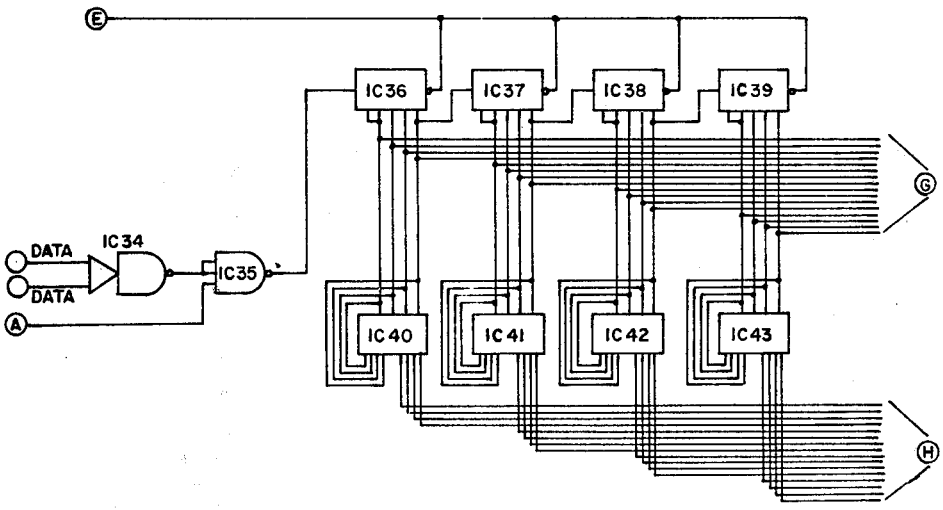

FIG. 9 shows the details of the first counting circuitry. The data signal from the camera (the camera produces two opposite data signals) enters the circuitry through a differential line receiver IC34. The data signal from IC34 is an input to NAND gate IC35. The second input to IC35 is the signal from IC10 of FIG. 8, which is transmitted through the conductors interconnected at terminal A. The output from IC35 is a negative pulse each time a sensor senses a defect during a scan of the camera.

The signal from IC35 is an input to the first of several binary counters IC36, IC37, IC38, and IC39 connected in series. The counters count the number of pulses received from IC35. This count represents the number of sensors which have sensed a defect since the counters were reset. The counters are reset by the reset signal from the circuitry of FIG. 11, which is supplied through conductors interconnected at terminal E.

The output of the counters is a signal representative of the number of pulses counted and is sent to the circuitry of FIG. 11 through conductors which are interconnected at terminal G. The output signals of the counters are also inputs to binary adders IC40, IC41, IC42, and IC43. These adders may be Signetics N7483, four bit full adders. The count of the counters is doubled by the adders. The output of the adders is a signal representative of double the count of the counters and is sent to the circuitry of FIG. 12 through conductors which are interconnected at terminal H.

The outputs of FIG. 9 are: a signal at terminal G representative of the number of sensors sensing a defect, and a signal at terminal H representative of double the number of sensors sensing a defect.

Figure 10:
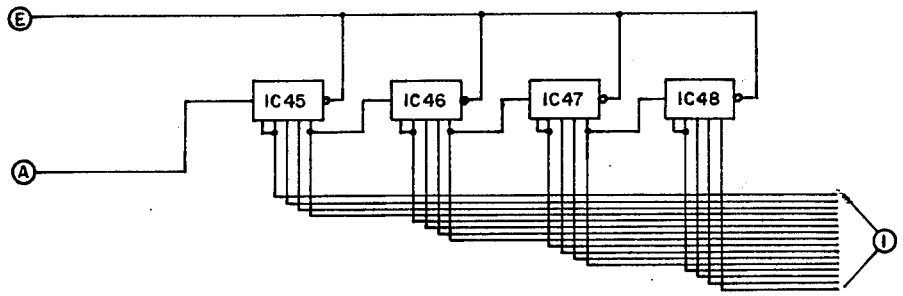

FIG. 10 shows in detail the circuitry of the second counting circuit.

The signal from terminal A of FIG. 8, a positive pulse for each sensor sensing a potato, is sent to the first of a series of counters IC45, IC46, IC47, and IC48, which count the pulses. The counters are reset by the reset signal from FIG. 11 taken from terminal E. The output of the counters, a signal representative of the number of sensors sensing a potato from the time the counters were reset, is sent to the circuitry of FIG. 12 through conductors interconnected at terminal I. The count signal at terminal I is the output of the circuitry of FIG. 10.

FIG. 11 shows in detail the circuitry of the first comparison circuit.

The count signal from terminal G of FIG. 9 is sent to comparitors IC50 and IC51. These may be Fairchild b 9324, five bit comparitors. The comparitors compare the count from the counters of FIG. 9 with a predetermined count, which is set into the comparitors by switches S1 through S8. Flip-flop IC52 produces a positive signal output, which becomes an input to comparator IC51 if the maximum count of the counters in FIG. 9 is exceeded. The flip-flop IC52 is reset for each new count.

The comparators IC50 and IC51 continuously compare the count from the counters of FIG. 9 with the predetermined count set by switches S1 through S8. An output from the comparitor is produced if either A, the set count, is less than B, the count from FIG. 9, or, if A is equal to B.

The A-is-less-than-B output of IC50 and the A equals B output of IC51, are inputs to AND gate IC53. This AND gate may be a Signetics N7454. If high signals are present on both inputs of IC53, the output will be high. Thus, if A is less than B for IC50 and A equals for IC51, an output is produced by IC53. The A equals B output of IC50 and the A equals B output of IC51, are inputs to AND gate IC54. Thus, if A equals B for IC50 and A equals B for IC51, an output is produced by IC54. The A-is-less-than-B output of IC51 is the input to AND gate IC55, so that IC55 produces an output if A is less than B for IC51. AND gate IC56 is an extra gate and is grounded, so produces no output.

The outputs from IC53 through IC56 are inputs to a single input NOR gate IC57, such as a Signetics 7454. If the input to IC57 is high, the output goes low. Thus, IC57 produces a low output if there is a high output produced by IC53, IC54, or IC55. This low signal from IC57 indicates that the number of sensors sensing a defect is greater than the preset number and that, therefore, the potato should be rejected.

The signal from IC57 is inverted by inverter IC58. The output of IC58 is an input to NAND gate IC59. The other input to IC59 is a signal from FIG. 12 which indicates the end of a potato. The signal is sent to the circuitry of FIG. 11 through conductors interconnected at terminal J. IC59 produces a negative pulse when a reject signal and end potato signal are present.

The signal from IC57 is also an input to NAND gate IC60. The end potato signal from terminal J is also an input to IC60. IC60 goes low when there is no reject signal output on IC57 (output of IC57 is high) and there is an end potato signal. Thus, for each end potato signal from terminal J, either IC59 will produce a negative pulse if the potato is to be rejected or IC60 will produce a negative pulse if the potato is not to be rejected.

NAND gates IC61 and IC62 form a latch circuit to produce an output at terminal K of a high level if the potato is not to be rejected and a low level if the potato is to be rejected. The signal at terminal K can change only upon receipt of end potato signals from terminal J. The signal at terminal K is inverted by inverter IC63. The output at IC63 causes light emitting diode D2 to light if the signal at terminal K is low, indicating a defective potato. Resistor R4 is a current limiting resistor.

The signal from terminal D of FIG. 8 is inverted by inverter IC64. The signal from IC64 is a positive pulse for each scan of the camera during which a sensor does not detect a potato, if that scan occurs before four successive scans during which a sensor has sensed a potato. This signal is inverted again by NAND gate IC65, again by NAND gate IC66, and again by inverter IC67. The output of IC67 is a negative pulse for each negative pulse from terminal D. IC65 and IC66 act as inverters when one of each of their inputs is a +5 volt signal from a +5 volt source as shown. Resistors R5 and R6 are current limiting resistors. The high signal from the +5 volt source is an input to IC65 and IC66 for the circuitry of FIG. 11 associated with the first camera.

For the circuitry of FIG. 11 associated with each of the additional cameras, the conductors connected between IC65 and resistor R5 and IC66 and resistor R6 are connected through the negative breaks indicated, rather than to the resistors mentioned. Thus, a conductor runs between IC65 and ground, causing a constant low input to IC65 rather than the constant high input which occurs when the conductor runs to R5 and the 5 volt source. A conductor also connects IC66 of circuitries associated with other than the first camera to IC67 of the circuitry associated with the first camera, causing the output of IC67 of the first camera circuit to be an input to IC66 for the circuitries associated with other than the first camera. In this way, the reset signal for all camera circuits is slaved to the reset signal from the circuitry of FIG. 11 associated with the first camera. When IC67 of the circuitry associated with the first camera produces a negative pulse, IC66 of the circuitries associated with the remaining cameras will produce a positive pulse causing a negative output pulse from IC67 in each of the circuitries for the remaining cameras.

The output of IC67 is an input of NAND gate IC68. The other inputs to IC68 are to outputs of IC59 and IC60. If any one of these inputs to IC68 goes low (IC67 goes low indicating that a scan has occurred with no sensor sensing a potato and that this scan has occurred before four successive scans during each of which sensors have sensed a potato; IC59 goes low indicating the end of a potato to be rejected; and IC60 goes low indicating the end of a good potato) the output of IC68 goes high. This signal is delayed by delay line IC69 for 150 nanoseconds and is inverted by inverter IC70. The negative pulse from IC70 is used to reset flip-flop IC52. The signal from IC70, inverted again by IC71, resets counter IC25 and flip-flop IC27 of the circuitry of FIG. 8, and resets the counters of FIS. 9 and 10. This is the reset signal that is transmitted by the conductors interconnected at terminal E.

Thus, the outputs of the circuitry of FIG. 11 are a signal at terminal K, indicating whether or not a potato is to be rejected, and a reset signal at terminal E, indicating the end of a potato or that a potato has been sensed for less than four successive scans of the camera. If a potato is sensed for less than four successive scans, some small extraneous object has actually been sensed, rather than a potato.

Figure 12:
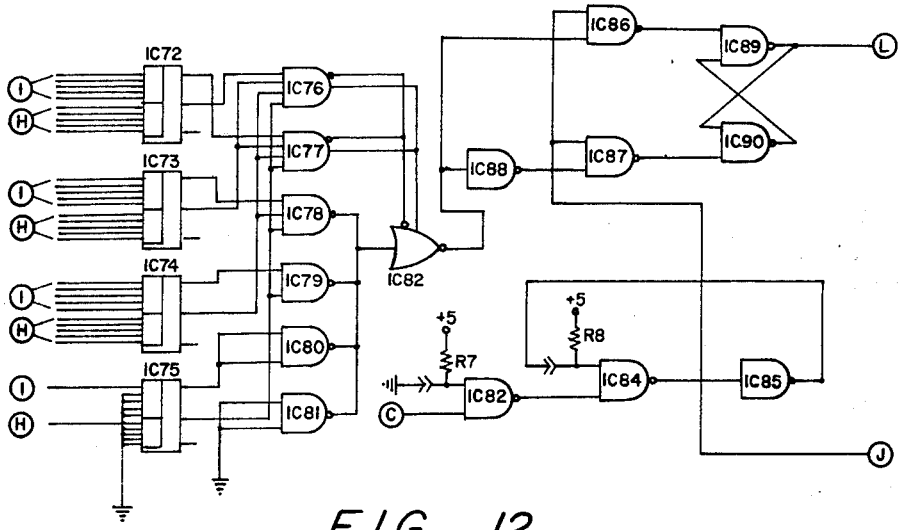

FIG. 12 shows in detail the circuitry of the second comparison circuit.

The output of the adders of FIG. 9, a signal which represents double the count of the number of sensors sensing defects, is the input to one portion of each of four comparators IC72, IC73, IC74 and IC75. The signal from the adder is transmitted to the comparators by conductors interconnected at terminal H. The output of the counter of FIG. 10, a signal which represents the number of sensors sensing a potato, is the input to a second portion of each of the comparators IC72, IC73, IC74 and IC75. The signal from the counter is transmitted to the comparators by conductors interconnected at terminal 1.

The comparators compare the count signals is sent to their two portions and each produce an output if A (the count of the sensors sensing a potato) is less than B (double the count of the sensors sensing defects) or if A is equal to B. The signals from the comparators are inputs to AND gates IC76 through IC81. IC78 through IC81 are similar to IC53 through IC56, while IC76 and IC77 may each be a Signetics N74H60 four input expander.

The A equals B signals from the four comparators are inputs to AND gate IC76. If all inputs indicate A equals B then a high signal is produced at the AND output of IC76 and a low signal is produced at the NAND output of IC76. The outputs are low and high, respectively, for other inputs.

The A-is-less-than-B signal from IC72 and the A equals B signals from IC73 through IC75 are inputs to AND gate IC77. Again, if all inputs are high, the AND output is high and the NAND output is low.

The A-is-less-than-B signal from IC73 and the A equals B signal from IC74 and IC75 are inputs to AND gate IC78. The AND output is the only output from IC78 and is high with all inputs high. The A-is-less-than-B signal from IC74 and the A equals B signal from IC75 are the inputs to AND gate IC79. The A-is-less-than-B output of IC75 is the input to AND gate IC80. IC81 is extra and is grounded, so has no output.

The outputs of IC76 through IC81 are connected to an expandable NOR gate IC82 which may be a Signetics N74H53. The output of IC82 goes low if there is an output from any of the AND gates IC76 through IC81, and such output indicates that 50% or more of the sensors sensing a potato are sensing a defect. This is the second reject signal.

The signal from terminal C of FIG. 8 is an input of NAND gate IC83. This signal from FIG. 8 is positive after four successive scans during which none of the sensors have sensed a potato, and indicates the end of a potato passing through the illumination chamber. In the circuitry of FIG. 12 for the first camera, the other input of IC83 is a continuous high level signal produced by a 5 volt source. IC83, therefore, acts as an inverter. The inverted signal is again inverted by NAND gate IC84, which acts as an inverter because its other input is a continuous high level signal produced by a 5 volt source. The output of IC84 is inverted by inverter IC85. Resistor R7 and R8 limit current flow.

As with the reset signal, the end potato signal is slaved to the first camera's circuitry. Thus, the end potato signal from the circuitry of FIG. 12 for the first camera is used as the end potato signal for the remaining 3 camera circuits. In the circuitry of FIG. 12, for cameras other than the first one a conductor connecting IC83 to ground causes a continuous low level input to IC83, rather than the high level input that is provided by the 5 volt source in the circuit for the first camera. This means that the outut of IC83 is always a positive signal in these circuits. In the circuitry of FIG. 12, for cameras other than the first one a conductor connects IC84 of that circuit with IC85 of the circuit for the first camera. The input to IC84 is thus the output signal from IC85 of the first camera's circuit. Therefore, each time the circuitry for the first camera generates an end potato signal, similr signals are generated by IC84 and IC85 of the circuitry for each additional camera.

The output of IC84, a positive signal indicating the end of the potato, is sent to the circuitry of FIG. 11 by means of conductors interconnected at terminal J. The output of IC84 is also an input to both NAND gates IC86 and IC87. The output of IC82 is the second input to IC86. IC86 provides a negative going pulse at the end of a potato when IC82 does not produce a reject signal. The output of IC82 is inverted by inverter IC88. The output of IC88 is the second input of IC87. IC87 produces a negative going pulse at the end of a potato when IC82 does produce a reject signal.

NAND gates IC89 and IC90 are connected to form a latching circuit, so that, upon a negative going pulse output from IC86, the output at terminal L will go high and remain high until a negative going output pulse is received from IC87. The negative going output pulse from IC87 causes the output at terminal L to go low and remain low until a negative output pulse is received from IC86. The low level at terminal L indicates that the potato sensed should be rejected, because over 50% of the potato sensed by at least one set of sensors is defective.

Up to this point, all circuitry described is duplicated for each set of light sensors (each camera). The circuitry hereinafter described is common to al cameras utilized, and is interconnected with the electronics of each camera.

Figure 13:
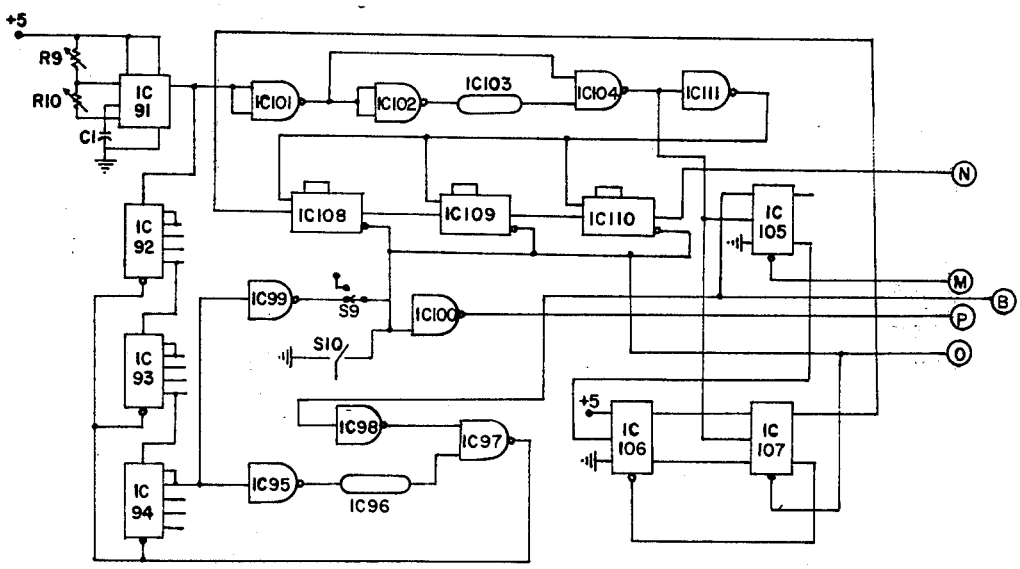

FIG. 13 shows the details of the item tracking circuitry.

A timer IC91, such as a Signetics 555, is connected with resistor R9 and R10 and capacitor C1 to form an oscillator. The output pulses from the oscillator are counted by three binary counters IC92, IC93, and IC94 arranged in series. IC94 produces a positive output if 256 pulses from the oscillator are counted before the counters are reset.

The output of counter IC94 is inverted by inverter IC95 and delayed 150 nanoseconds by delayline IC96. The delayed output of IC96 is an input to NAND gate IC97. The start potato signal from terminal B of FIG. 8 for the first camera is inverted by inverter IC98. The output of IC98 is the second input of IC97. The output of IC97 goes high to reset the counter if either the input from IC96 goes low, indicating 256 oscillator pulses, or the input from IC98 goes low, indicating the camera has sensed a potato for four successive scans.

The signal from IC94 is also inverted by inverter IC99. IC99 is connected through switch S9 to NAND gate IC100. Switch S9 is used to select either automatic initiation of the operation of the tracking circuitry or manual initiation of the operation of the tracking circuitry. For manual initiation, the switch S9 is in position so that one input of IC100 receives a continuously high signal from the 5 volt source. Manual operation is desirable, particularly when trouble shooting the circuits. For automatic initiation, switch S9 is in position so that the output of IC99 is one input of IC100. The other input of IC100 is open, so acts as a high signal unless switch S10 is closed causing a low input to IC100.

The output of oscillator IC91 is in an input to NAND gate IC101, which operates as an inverter. The inverted signal is inverted again by NAND gate IC102, delayed for 150 nanoseconds by delay line IC103, and then sent as an input to NAND gate IC104. The output of IC101 is also an input to IC104. IC104 produces a 150 nanosecond negative going pulse beginning at the trailing edge of the oscillator pulse.

The output from IC104 is sent to flip-flop IC105. The output of IC105 is sent to flip-flop IC106. If there is a low signal at terminal B (low unless there have been four successive scans of the camera during each of which at least one sensor senses a potato) which is also an input to IC105, a positive signal is provided by IC105 to IC106. If a positive signal (start potato signal) is present at terminal B, upon the next negative pulse from IC104, the output of IC105 changes and IC105 provides a low signal to IC106. The output of IC105 will remain unchanged until a reset signal is received through terminal M from the circuitry of FIG. 14. The change from a high signal to low signal produces a negativve going pulse which causes the outputs of IC106 to be high for the top output shown and low for the bottom output shown. With these outputs, which are connected to flip-flop IC107, the next negative pulse output from IC104 causes the top output of IC107 to be high and the bottom output to be low. The change from a high to low output on the bottom output of IC107 causes IC106 to reset, which causes the outputs of IC106 to change state, causing the outputs of IC107 to change states on the next negative going pulse from IC104. IC106 and IC107 will remain in these states until IC105 is reset and will then change states again upon receiving a start potato pulse from terminal B and a pulse from IC104. In this way, a pulse from oscillator IC91, which is asynchronous with the start potato signal is sychronized so that IC107 produces an output pulse upon receipt by it of both an oscillator pulse (from IC104) and a start potato pulse.

The output from IC107, which goes high, is an input of the first of three shift registers IC108, IC109, and IC110 connected in series. Each shift register may be a Fairchild 9328. The high signal from IC107 sets a bit in the first shift register IC108. Because of the synchronization of the oscillator and start potato signal, as indicated aove, one bit and only one bit is set in the shift registers for each start potato pulse. The output of IC104 is inverted by inverter IC111. The signal from IC111 is a positive 150 nanosecond pulse for each pulse from the oscillator IC91. The output of IC111 is the clock input to each of the shift registers IC108, IC109, and IC110, and each pulse from IC111 causes the bit to advance one position through the register. Thus, when a bit is set by the high output of IC107 in the first position of IC108, that bit is moved one position on each pulse from IC111 until it reaches the end of the last shift register IC110. It then causes a positive output at terminal N, which is sent to the circuits shown in FIGS. 14 and 15.

Figure 14:
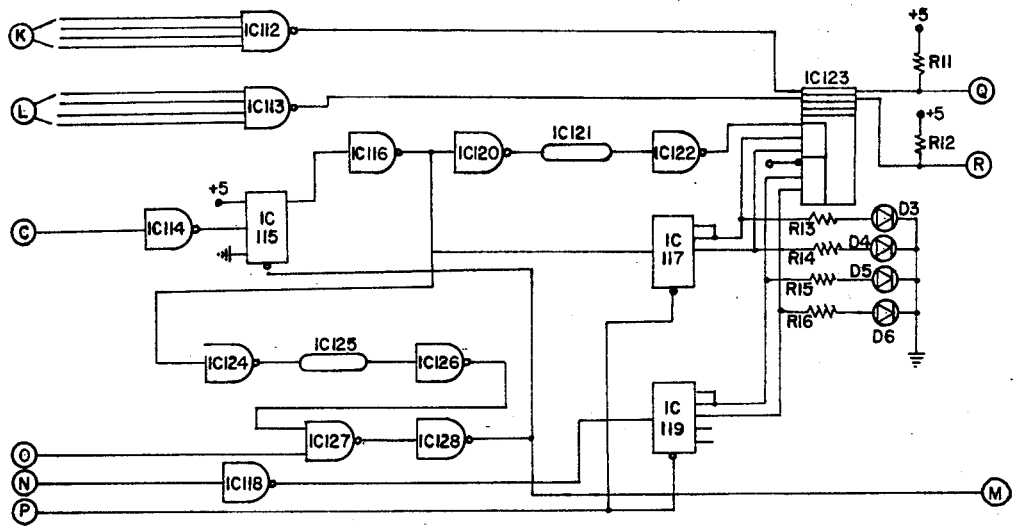

The shift registers and the flip-flop IC107 are reset by manual command switch S10, which is closed momentarily to ground the reset terminals of the shift registers and of flip-flop IC107. This removes all information in the shift registers. Terminal 0, connected to the circuitry of FIG. 14, is also grounded when switch S10 is closed.

With switch S9 in position so that an input of IC100 receives a high signal from the 5 volt supply (the position for manual command operation) the grounding of the other input to IC100 by closing switch S10 causes a positive pulse output from IC100. For automatic operation, with S10 open and S9 in position so that the output of IC99 is an input of IC100, a positive output pulse from IC100 is produced upon receiving a negative pulse from IC99. The negative pulse from IC99 indicates a count of 256 oscillator pulses. The output of IC100 is sent to the circuitry of FIG. 14 through conductors interconnected at terminal P.

The circuitry of FIG. 13 provides an output signal delayed from the start potato signal of the circuitry of FIG. 8 for the first camera. The delay time is the time that it takes for a signal to be shifted through the shift registers. This delay time may be adjusted by adjusting the oscillator frequency or by adjusting the shift register length. The length of time delay should be equal to the time that it takes a potato to fall from its position just entering the illumination chamber (after four successive scans of the camera have sensed it) to its position adjacent the reject means.

The delay time is thus measured from the start of sensing a potato in the illumination chamber and is a correct delay time no matter how large or small the potato may be. If timing of the delay begins only after a reject signal is generated or after the potato moves from view in the illumination chamber, the delay time would have to be set for an average size potato and might be too long for other than average size potatoes, resulting in improper rejection of such potatoes.

FIG. 14 shows the details of the circuitry of the memory means.

The signals from the circuitry of FIG. 11, which indicate whether or not a potato is to be rejected, are inputs to NAND gate IC112, which may be a Signetics 7420. Four inputs are shown, each one from a separate circuit associated with a separate camera. IC112 produces a positive output pulse upon receiving a negative reject signal from any of the four circuits.

The signals from the circuitry of FIG. 12, which indicate whether or not a potato is to be rejected, are inputs to NAND gate IC113. Again, four inputs are shown, each one from a separate circuit associated with a separate camera. IC113 produces a positive output pulse upon receiving a negative reject signal from any of the four circuits.

If the potato is to be rejected because the defect count is above the preset number but is less than 50% of the total count, only IC112 produces a positive output signal. If the potato is to be rejected because the defect count is greater than 50% of the total count, both IC112 and IC113 produce positive output signals.

The end potato signal (high after four successive scans with no potato sensed) from terminal C of the circuitry of FIG. 8 for the first camera, is inverted by inverter IC114 and is sent to flip-flop IC115. The output of IC115 goes high upon receiving the negative going, end potato pulse from IC114 and remains high until it is reset.

The output from IC115 is inverted by inverter IC116. The signal from IC116 is sent to binary counter IC117, which counts the end potato pulses from IC116.

The delayed start potato signal from terminal N of the circuitry of FIG. 13 is inverted by inverter IC118 and sent to binary counter IC119, which counts the delayed pulses indicating the start of a potato.

The output of IC116 (end potato signal) is inverted by IC120, delayed by 150 nanoseconds by delay line IC121, and inverted again by inverter IC122. The output of IC122 is a negative going pulse delayed 150 nanoseconds from the pulse indicating the end of a potato. This output of IC122 is sent to a 4 × 4 tracking memory IC123, such as a signetics N74170.

The outputs of IC112 and IC113, the reject signals, and the outputs of counters IC117 and IC119 are also sent to memory IC123.

The operation of the memory is as follows:

With each end potato pulse, IC117 adds one to its count. IC117 is arranged to count to four and then to begin over again. The count output of IC117 is the input to IC123 that determines the address for information input to the memory.

With each delayed start potato pulse, counter IC119 adds one to its count. IC119 is also arranged to count to four and then begin again. The count ouput of IC119 is the input to IC123 that determines the address for information output from the memory.

Upon receiving a pulse from IC122 (delayed from end potato pulse), the memory accepts into a memory space the signals present on its inputs from IC112 and IC113. The address of the memory space accepting the information is determined by the count of IC117. The memory is connected so that it continuously puts out information from one memory space. The address of that memory space is determined by the count of IC119. The count of IC117 changes upon receipt of the end potato pulse as provided by IC116. The count of IC119 changes upon receipt of the delayed start potato pulse from IC118. The counts of the two counters should be the same if the system is operating properly, but the count change of IC117 should occur before the count change of IC119. Thus the reject information is stored in a memory upon receipt by the memory of the delayed end potato pulse, and the information is read out of the memory to the interface circuitry of FIG. 15 upon receipt by counter IC119 of the delayed start potato pulse. This delay insures that the proper reject information is sent to the reject means at the time the potato to be rejected is adjacent the reject means. The output information of the memory is sent to the circuitry of FIG. 15 through conductors interrconnected at terminals Q and R. Resistors R11 and R12 are load resistors. For a zero memory output signal, the memory will ground its output, and, for a positive signal, it will be essentially an open circuit. The open circuit causes the 5 volts from the 5 volt source to be the positive output.

If the potato is not to be rejected, no signals appear on either terminal Q or R. If the potato is to be rejected, the reject information will appear on terminal Q or on both terminals Q and R. The combination of signals on terminals Q and R represents the reject signal.

Resistors R13 through R16, associated with light-emitting diodes D3 through D6, are connected to counters IC117 and IC118, respectively, to give a visual indication of the count of each counter. The count can be an indication of whether or not the system is functioning properly, since, when the system is functioning properly, both counters shown the same count.

The signal from IC116, which is a negative pulse coincident with the pulse from the circuitry of FIG. 8 indicating the end of a potato, is inverted by inverter IC124, is delayed 150 nanoseconds by delay line IC125, and is reinverted by inverter IC126. The output of IC126 is an input to NAND gate IC127. The other input of IC127 is open, unless manual command switch S10 in FIG. 13 is closed making the input low. Upon closing switch S10, IC127 produces a positive pulse. With S10 open, a pulse from IC126 causes IC127 to produce a positive pulse. This pulse is inverted by inverter IC128, and the inverted pulse is used to reset flip-flop IC115 and is sent to the circuitry of FIG. 13, through conductors interconnected at terminal M, to reset flip-flop IC105.

Figure 15:
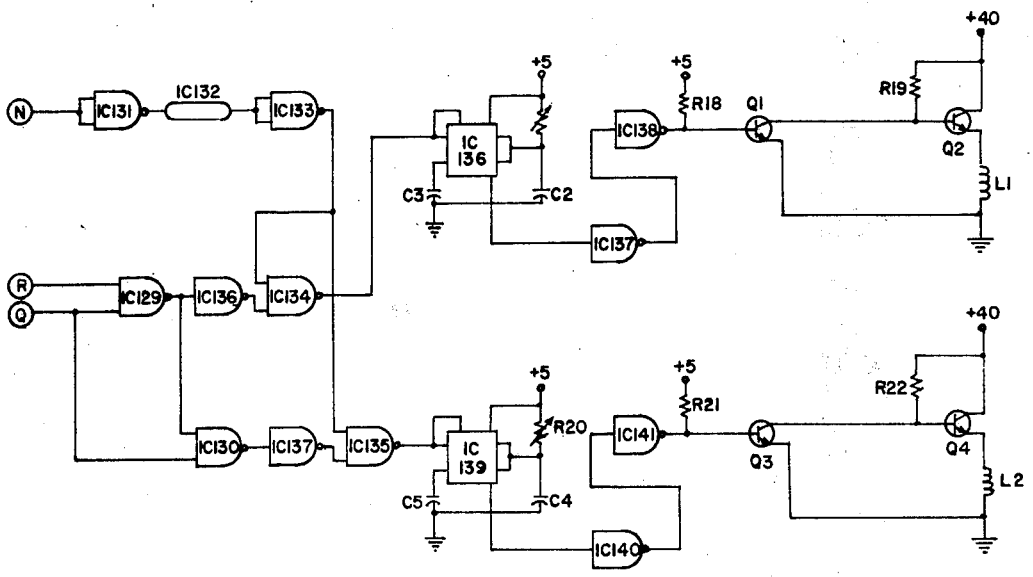

FIG. 15 shows the details of the interface circuit and the connections to the reject means.

The signals from the memory of FIG. 14 (from terminals Q and R) are inputs to NAND gate IC129. The output of IC129 goes low if positive signals are present on both inputs; otherwise, the output is high. The output of IC129 and the signal from terminal Q are inputs to NAND gate IC130. The output of IC130 goes low if both inputs are high. Thus, a negative signal is produced by IC129 if a positive signal is present at both terminals Q and R, and a negative signal is produced by IC130 if a positive signal is present at only terminal Q.

The delayed start potato signal from terminal N of FIG. 13 is an input to NAND gate IC131, connected as an inverter. The inverted signal is delayed for 150 nanoseconds by delay line IC132 and inverted again by NAND gate IC133. The signal from IC133 is an input to NAND gates IC134 and IC135. The other input to IC134 is the output of IC129, inverted by inverter IC136. IC134 produces a negative pulse upon a high signal from IC133 and a high signal from IC129. The other input to IC135 is a negative pulse upon receiving a high signal from IC133 and a high signal from IC130.

The output from IC134, a negative pulse if more than 50% of the surface seen by at least one of the cameras is defective, initiates a positive output pulse from timer IC136. The timer is connected with external resistor R12 and capacitors C2 and C3, so that, upon a negative pulse being received from IC134, the timer produces a positive output signal of controlled, predetermined length. This signal is inverted by inverter IC137 and inverted again by an open collector inverter IC138, which may be a Signetics 7405. Inverter IC138 acts as an open circuit during the pulse from timer IC136, causing the 5 volts from the 5 volt source (the source is otherwise grounded through IC138) to appear at the base of transistor Q1, causing it to conduct. This in turn causes transistor Q2 to conduct, causing the 40 volt source on the collector of transistor Q2 to appear across the solenoid valve coil L1. This causes the air valve associated with nozzle 25-2 of the reject means at the bottom of the illumination chamber to open and a blast of air to be released through air nozzle 25-2, causing the potato passing the air nozzle to be deflected into section 21C of hopper 21. Thus, potatoes with more than 50% defects are sent to waste. Resistor R18 is a pull-up resistor and R19 is a bias resistor.

The signal from IC135, a negative pulse if for at least one camera the number of sensors sensing defects is more than the predetermined number but less than 50% of the number sensing the potato, initiates a positive output pulse from timer IC139. IC139 is connected with resistor R20 and with capacitors C4 and C5 to produce a timed output pulse similar to that of IC136. The output of IC139 is inverted by inverter IC140 and again by open collector inverter IC141. Upon receiving a positive signal from IC141, transistors Q3 and Q4 conduct, causing the 40 volt source to be applied across solenoid valve coil L2. This causes the air valve associated with nozzle 25-1 of the reject means to open, causing a blast of air from nozzle 25-1 to deflect the potato into section 21b of bin 21 and onto belt 24. These potatoes may then be sent to a separate product line or to an area where defects are removed. Again, R21 is a pull-up resistor and R22 a bias resistor.

Transistor Q1 and Q3 may each be a Sylvania ECG 128 and transistor Q2 and Q4 may each be a Sylvania ECG 130. THe solenoid valves which control the air blasts may each be a Bellows L355-49-112.

If the second comparison circuit is not provided in the system, there will be only a single reject signal. Under such circumstances, only a single nozzle and associated air valve will be provided. All potatoes will then be rejected into the same area for either further processing or for disposal.

A power supply for the circuit is not shown, but is provided in any suitable manner to supply power to the circuit components through the usual type of connections.

For best results with the system, since the electronics are set up to detect the end of a potato and to reset the system for the next potato upon a count of four consecutive scans without a potato in view, and since, at the desired potato speed of 680 feet per minute, there are approximately 10 scans per inch of potato, the distance between potatoes passing through the illumination chamber should be at least one-half inch.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. Apparatus for sorting items, each of which exhibit substantially uniform light reflectivity if the item is in normal condition and different light reflectivity for any portion or portions thereof that are in abnormal condition, comprising:

an illumination chamber for substantially uniformly illuminating the items to be sorted and for establishing a substantially uniformly illuminated background at a different light level from that of the light reflected by the items to be sorted and by abnormalities in the items to be sorted;

means for successively passing a stream of items to be sorted through the illumination chamber;

at least one set of a multiplicity of individual light, each set arranged to sense light reflected in substantially a single direction from items passing through the illumination chamber, the individual light sensors of a set being localized as a closely associated group so as to each sense only a small portion of the total light sensed by the set, each of said individual light sensors being capable of sensing differences in light reflected from the items in their normal condition, light reflected from one or more abnormalities in the items, and light reflected from the background in the chamber;

means for distinguishing between sucessive items entering the illumination chamber and for associating each sensor sensing an abnormality with a particular item by determining from the light sensed by said sensors whether the respective individual sensors are sensing light reflected from an item in its normal condition, light reflected from an abnormality in the item, or light reflected from the background in the chamber, and for determining whether the number of individual sensors sensing abnormalities in a particular item is greater than a predetermined number;

means for rejecting an item from the stream of items if the number of sensors sensing abnormalities in an item is greater than the predetermined number; and means for delaying operation of said rejecting means until the item to be rejected reaches the rejecting means along its path of travel following the sensing operation.

2. Apparatus according to claim 1, wherein the items to be sorted are white potatoes and the abnormalities are defects in the potatoes.

3. Apparatus according to claim 1, wherein the background to be sensed is illuminated more brightly than the light reflected from an item to be sorted and the light reflected from a defect in the item is not as bright as the light reflected from the item.

4. Apparatus for sorting items, each of which exhibit substantially uniform light reflectivity if the item is in normal condition and different light reflectivity for any portion or portions thereof that are in abnormal condition, comprising:

an illumination chamber for substantially uniformly illuminating the items to be sorted and for establishing a substantially uniformly illuminated background at a different light level from that of the light reflected by the items to be sorted and by abnormalities in the items to be sorted;

means for successively passing a stream of items to be sorted through the illumination chamber;

at least one set of a multiplicity of individual light sensors, each set arranged to sense light reflected in substantially a single direction from items passing through the illumination chamber, the individual light sensors of a set being localized as a closely associated group so as to each sense only a small portion of the total light sensed by the set, each of said individual light sensors being capable of sensing differences in light reflected from the items in their normal condition, light reflected from one or more abnormalities in the items, and light reflected from the background in the chamber;

a control circuit for each set of sensors to interrogate each sensor in the set to determine the amount of light sensed by it;

a data circuit for each set of sensors to compare the light sensed by a sensor with a predetermined signal level to determine if the sensor is sensing an abnormality;

a detecting circuit for each set of sensors to determine when the sensors begin to sense an item and when they stop sensing an item, so that the number of sensors sensing abnormalities in an item are determined for each item to be sorted;

a counting circuit for counting the number of sensors sensing abnormalities for each item;

means for comparing the number of sensors sensing abnormalities in an item with a predetermined number;

means for rejecting an item from the stream of items if the number of sensors sensing abnormalities in an item is greater than the predetermined number; and means for delaying operation of said rejecting means until the item to be rejected reaches the rejecting means along its path of travel following the sensing operation.

5. Apparatus according to claim 4, wherein the detecting circuit is adapted to detect an item for a certain minimum period before the circuit determines that the sensors are sensing an item, thereby preventing a small stray item that inadvertently passes through the illumination chamber from being detected as the start of an item to be sorted.

6. Apparatus according to claim 5, wherein the detecting circuit is arranged so that the absence of an item must be detected for a certain minimum period before the circuit determines that the sensors have sensed the end of an item, thereby preventing a possible irregularity in the item or anomaly in the circuit from being detected as the end of an item being sorted.

7. Apparatus according to claim 6, wherein the control circuit for each set of sensors is adapted to generate a clock signal for the particular set concerned, to also sequentially interrogate each sensor of that set in a predetermined pattern in accordance with said clock signal, thereby generating a level signal proportional to the amount of light sensed by the particular sensor being interrogated, and to also generate an enabling signal having one state indicating that interrogation is taking place during certain portions of said clock signal and a second state indicating that interrogation is not taking place during certain other portions of said clock signal;

the data circuit for each set of sensors is electrically interconnected with the control circuit for that set so the data circuit will determine whether the signal representative of light sensed by a particular sensor of that set is above or below the predetermined level and will produce a data signal having one state if the level is above the predetermined level and a second state if the level is below the predetermined level;

the detecting circuit for each set of sensors is electrically interconnected with the control circuit for that set so that the detecting circuit will determine whether the level signal proportional to light sensed by a sensor of that set is above or below a second predetermined level, will also determine if the level sensed by at least one sensor of the set during each of a predetermined number of successive interrogation patterns is in a given state relative to the second predetermined level, and will also produce an item signal having one state if the level sensed by said at least one sensor during each of said predetermined number of successive interrogation patterns is in said given state and having a second state if not, but, if so, will remain in that state until a predetermined number of successive interrogation patterns occur during which the level sensed by none of the sensors is in said given state; and the counting circuit for each set of sensors is electrically interconnected with the control, data, and detecting circuits for that set so as to count the total number of sensors in that set whose level signal has a predetermined relationship with the level predetermined by the data circuit over successive interrogation patterns during the time the item signal is in, and remains in, a given one of its two states.

8. Apparatus according to claim 7, wherein the means for comparing comprises a comparison circuit for each set of sensors, said comparison circuit and the counting circuit of each set being electrically interconnected so as to compare the number of sensors counted by the counting circuit of that set with a predetermined number and to produce a reject signal if the number of sensors counted is greater than the predetermined number; and the means for rejecting comprises means for moving an item out of the stream of items passing through the illumination chamber, electrical control means therefor, and interface means electrically connected to said control means and to the comparison circuit of each set of sensors so as to effect operation of the reject means after receipt of a reject signal for that item.

9. Apparatus according to claim 8, wherein means are additionally included for comparing the number of sensors sensing abnormalities in an item with the total number of sensors sensing that item; and the means for rejecting an item is adapted to move an item from the stream of items into one area if the number of sensors sensing abnormalities for that item is greater than the predetermined number but less than a given percentage of the total number of sensors sensing that item, and into a second area if the number of such sensors is above said given percentage of the total number of sensors sensing that item.

10. Apparatus according to claim 9, wherein the means for comparing the number of sensors sensing abnormalities in an item with the total number of sensors sensing an item comprises a second counting circuit for each set of sensors, the second counting circuit and the detecting circuit of each set being interconnected so that the second counting circuit will count the total number of sensors whose level signal has a predetermined relation to the second level predetermined in the detecting circuit over consecutive interrogation patterns during the time the item signal is in, and remains in, the given one of its two states, and comprises, further, a second comparison circuit for each set of sensors, the second comparison circuit and the first and second counting circuits of each set being interconnected so that said second comparison circuit will compare the counts of the respective counting circuits and produce a second reject signal if the count of the first counting circuit is over a given percentage of the count of the second counting circuit;

the means for moving an item is adapted to direct an item out of the stream of items passing through the illumination chamber into one of two possible areas; and the interface means is adapted to effect operation of the reject means so that an abnormal item is directed out of the stream into one of said areas if the reject signal received is a second reject signal, but is directed into the other of said areas if the reject signal received is not a second reject signal.

11. Apparatus according to claim 10, wherein the means for delaying comprises a memory circuit for all the sets of sensors in common, the detecting circuit and the first and second comparison circuits of each set of sensors being electrically connected to said memory circuit, so as to store a predetermined number of the most recent reject signals, or of the indication of absence of reject signals, there being one signal or indication of absence thereof stored for each period of time the item signal is in the predetermined one of its two states; and an item tracking circuit electrically connected between the detecting circuit of a selected one of the sets of sensors and said memory circuit to keep track of the position of each item as it flows through the illumination chamber and past the reject means and to cause the correct reject signal, or indication of absence of reject signal, to be transmitted from the proper memory position of the memory circuit to the interface circuit so the reject means is operable on the correct item from the stream of items passing by.

12. Apparatus according to claim 11, wherein the tracking circuit is adapted to keep track of an item by providing a time delay before it causes reject information for an item to be sent to the interface means, such time delay beginning when the detecting circuit detects the start of that item and being substantially equal to the time it takes an item to travel from the position where the detecting circuit first detects it to the position where it may be rejected by the reject means;

means in said tracking circuit for producing a series of timing pulses asynchronous with the timing of the remainder of the apparatus; and means also in said tracking circuit to synchronize the item signal from the detecting circuit with the timing pulses, so that timing of the delay begins with the occurrence of the first full timing pulse after the item signal from the detecting circuit indicates that an item is being sensed.

13. Apparatus according to claim 12, wherein the means to synchronize the timing pulses and the item signal comprises means for generating negative going pulses coincident with the timing pulses, the negative going pulses being of proper form to serve as clock pulses for J-K flip-flops;

a J-K flip-flop adapted to set upon receipt by its clock input of one of said negative going pulses when the item signal from the detecting circuit is positive, the item signal being sent to the J input of the flip-flop and the signal being positive when the detecting circuit detects an item;

a second J-K flip-flop adapted to set upon receipt by its clock input of a negative going pulse from the first flip-flop, the negative going pulse being caused by the setting of the first flip-flop; and a third J-K flip-flop adapted to set upon receipt by its clock input of one of said negative-going pulses when the second flip-flop is set, the setting of the third flip-flop causing the resetting of the second flip-flop, which, in turn, causes the third flip-flop to reset upon receipt of the next of said negative going pulses, thereby causing an output of the third flip-flop to produce a positive pulse when the detecting circuit first detects an item, such positive pulse being of duration equal to the time occurring between two of said negative going pulses and being synchronized with such pulses.

14. Apparatus according to claim 13, wherein there is provided a series of shift registers; and means are provided whereby the positive signal from the third flip-flop causes a single bit to be set in the first space of said series of shift registers, the operation of said shift registers being timed by the timing pulses, and the delay time of the circuit being substantially equal to the time that it takes a bit to be shifted through said series of shift registers.

15. Apparatus according to claim 4, wherein each set of light sensors and associated control and data circuits are provided in a self-scanning, diode array camera; and each camera is focused upon a portion of the illuminated area through which the items to be sorted pass.

16. Apparatus according to claim 15, wherein the illumination chamber comprises a housing having a central passageway therethrough through which the items to be sorted are passed, and partition means having similar surfaces defining a plurality of passages radiating from said central passageway and providing the illumination background;

a plurality of light sources disposed peripherally of said housing at the ends of the respective passages, so as to direct light through said passages onto items passing through said central passageway and to illuminate said similar surfaces of the partition means substantially uniformly; and means mounting the cameras at spaced intervals about the periphery of said housing, so each focuses differently on said central passageway.

17. Apparatus according to claim 16, wherein additional light sources are mounted outside the housing adjacent to opposite ends of the central passageway, so as to insure complete illumination of the items passing through the illumination chamber.

18. Apparatus according to claim 16, wherein the illumination chamber includes means for cooling the interior of the housing.

19. Apparatus according to claim 18, wherein the cooling means includes means for circulating air about the light sources and about the light sensing means and for exhausting said air through the central passageway, whereby dust and dirt are prevented from entering said passageway.

20. A method of sorting items, each of which exhibit substantially uniform light reflectivity if the item is in normal condition and different light reflectivity for any portion or portions thereof that are in abnormal condition, comprising passing said items in single file, as a stream, through an illumination chamber;

substantially uniformly illuminating the items to be sorted while establishing a substantially uniformly illuminated background at a different light level from that of the light reflected by the items to be sorted and by abnormalities in the items to be sorted;

individually sensing in relatively small portions, the light reflected in at least one direction from items passing through the illumination chamber and distinguishing between sucessive items passing through the illumination chamber and associating sensed abnormalities with a particular item by distinguishing between light reflected from the items in their normal condition, light reflected from one or more abnormalities in the items, and background light from the illumination chamber;

comparing the number of individual sensings of abnormalities along said successive slices with a predetermined number; and rejecting an item from the stream of items if the number of abnormality sensings for that item are greater than the predetermined number.

21. A method of sorting items, each of which exhibit substantially uniform light reflectivity if the item is in normal condition and different light reflectivity for any portion or portions thereof that are in abnormal condition, comprising passing said items in single file, as a stream, through an illumination chamber;

substantially uniformly illuminating the items to be sorted while establishing a substantially uniformly illuminated background at a different light level from that of the light reflected by the items to be sorted and by abnormalities in the items to be sorted;

individually sensing in relatively small portions, the light reflected in at least one direction from items passing through the illumination chamber and distinguishing between successive items passing through the illumination chamber and associating sensed abnormalities with a particular item by distinguishing between light reflected from the items in their normal condition, light reflected from one or more abnormalities in the items, and background light from the illumination chamber;

comparing the number of individual sensings of abnormalities for an item with a predetermined number;

comparing the number of individual sensings of abnormalities for an item with the total number of sensings of that item, to determine the percentage of abnormal sensings in said total number of sensings, and comparing the percentage so determined with a predetermined percentage;

rejecting an item from the stream of items to one area if the abnormality sensings for that item are greater than the predetermined number but less than the predetermined percentage and rejecting an item to another area if such abnormality sensings are greater than the predetermined percentage.

* * * * *

UNITED STATES PATENT OFFICE

CERTIFICATE OF CORRECTION

PATENT NO. : 4,147,619

DATED : April 3, 1979

INVENTOR(S) : Wassmer, Norman Brent, et al.

It is certified that error appears in the above-identified patent and that said Letters Patent are hereby corrected as shown below:

Column 12, line 46, "b" should be deleted.
Column 12, line 65, after "equals" insert --B--.
Column 13, line 55, "negative" should read --respective--.
Column 14, line 7, "to" should read --the--.
Column 14, line 20, "FIS." should read --FIGS.--.
Column 14, line 44, "1" should read --I--.
Column 14, line 45, "is" should read --as--.
Column 15, line 66, "al" should read --all--.
Column 17, line 10, "aove" should read --above--.
Claim 1, Column 21, line 14, after "light" insert --sensors--.
Claim 20, Column 26, line 28, "along said successive slices" should read --for an item--.

Signed and Sealed this

*Seventh* Day of *August 1979*

[SEAL]

*Attest:*

*Attesting Officer*

LUTRELLE F. PARKER

*Acting Commissioner of Patents and Trademarks*